United States Patent [19]

King

[11] 4,448,566

[45] May 15, 1984

[54] METHOD OF MAKING A LOAD BEARING SURFACE USING PHOSPHOGYPSUM AND FLYASH

[75] Inventor: H. Hobson King, Richmond, Va.

[73] Assignee: Mobil Oil Corporation, New York, N.Y.

[21] Appl. No.: 441,145

[22] Filed: Nov. 12, 1982

[51] Int. Cl.[3] ..... E01C 7/06; E01C 7/32

[52] U.S. Cl. ..... 404/31; 404/82; 404/75; 427/136; 264/34

[58] Field of Search ..... 404/75, 76, 82, 31, 404/27; 405/265, 266, 270; 264/34; 106/109, DIG. 1; 427/136

[56] References Cited

U.S. PATENT DOCUMENTS

| | | | |
|---|---|---|---|
| 3,854,968 | 12/1974 | Minnick et al. | 106/109 |
| 4,353,749 | 10/1982 | Ray et al. | 106/DIG. 1 |
| 4,374,672 | 2/1983 | Funston et al. | 106/DIG. 1 |

FOREIGN PATENT DOCUMENTS

| | | | |
|---|---|---|---|
| 614055 | 7/1978 | U.S.S.R. | 106/DIG. 1 |

*Primary Examiner*—Ernest R. Purser
*Assistant Examiner*—Mack J. DelSignore
*Attorney, Agent, or Firm*—Alexander J. McKillop; Michael G. Gilman; Lawrence O. Miller

[57] ABSTRACT

A method of making a load bearing surface comprising mixing flyash with phosphogypsum in predetermined amounts to form a subbase disposed on a subgrade, sequentially spraying water onto the subbase and compacting for a plurality of cycles until the materials therein are intimately mixed, densified, and the subbase layer is saturated with water. A base layer comprising a mixture of flyash and phosphogypsum in predetermined amounts is disposed on the subbase layer and sequentially sprayed with water and compacted for a plurality of cycles until the materials therein are intimately mixed, densified, and the base layer is saturated with water. The load bearing surface produced has CBR values ranging from 50 to 90 at 0.1 inch penetration.

17 Claims, No Drawings

METHOD OF MAKING A LOAD BEARING SURFACE USING PHOSPHOGYPSUM AND FLYASH

FIELD OF THE INVENTION

The invention relates to a method for making a load bearing surface utilizing flyash and phosphogypsum.

BACKGROUND OF THE INVENTION

Generally speaking, a pavement consists of the actual ground or subgrade, a subbase overlying the subgrade, a base overlying the subbase and a surface course or wear course on the top. A variety of materials have been used in the construction of pavements including aggregate bound together by a bituminous binder, cementitious mixture including flyash and gypsum, sand, soil cement, blast furnace slag, synthetic aggregates and other similar material depending upon the particular layer.

It has already been proposed to utilize phosphogypsum prepared as a by-product from the manufacture of phosphoric acid by the wet process as fill or base in the construction of pavements and foundations, see French Pat. No. 2,340,405. The French patent discloses a paving composition containing phosphogypsum having a moisture content of between 8 and 23%.

Flyash has also been used in paving compositions, U.S. Pat. No. 3,854,968 to Minnich et al discloses a cementitious mixture composed of flyash, lime, and gypsum used to stabilize soils or to form a subsurface base for highways, runways, etc.

Phosphogypsum is available in large quantities as a by-product of the wet-process production of phosphoric acid, with the formula $CaSO_4.2H_2O$. As a rule, 5.1 tons of phosphogypsum are produced for each ton of phosphoric acid produced. For instance, the Florida phosphate industry generates 33 million tons of phosphogypsum annually and only a small fraction (about 700,000 tons) is used for agricultural purposes, see the article by May et al. entitled, "Assessment of Environmental Impacts Associated with Phosphogypsum in Florida," U.S. Dept. of Interior, Bureau of Mines, *Report of Investigations* 8639, 1982.

Flyash is a finely divided ash residue produced by the combustion of pulverized coal, which ash is carried off with the gases exhausted from the furnace in which the coal is burned and which is collected from those gases usually by means of suitable precipitation apparatus such as electrostatic precipitators. This flyash, which is a siliceous or alumino-siliceous material, having the physical properties of a solid yet fluid-like dust or powder, had less than a 10 percent utility as recently as 1977, a year in which an estimated 45 million tons was produced as a by-product of generating electricity. Flyash could be and was used in negligible amounts in combination with lime to produce a cementitious composition. It was not competitive, however, with the traditional form of cement, popularly known as Portland cement, in part because it required a substantially longer setting up or hardening period.

Therefore, there is urgent need to develop a method of disposing of flyash and phosphogypsum in an environmentally acceptable, economical and productive manner.

Applicant, in accordance with the present invention, has found a novel method for making a load bearing surface having a high load bearing capacity using mixtures of flyash and phosphogypsum.

SUMMARY OF THE INVENTION

In accordance with the present invention, a layer of phosphogypsum, preferably 4 to 7 inches thick, is spread over a subgrade and a layer of flyash is spread over the phosphogypsum in an amount equal to 10 to 30 percent by weight of the total weight of flyash and phosphogypsum. The layer of flyash and phosphogypsum are mixed as for example by pulver mixing, or discing and blading, and compacted, such as, for example, by a roller or a tamping compactor, to form a subbase layer disposed on the subgrade. Thereafter, water is sprayed onto the subbase until the mixture is moist and soft and then compacted. This sequence of wetting and compacting the subbase layer is repeated until the materials are intimately mixed, densified, and the subbase layer is saturated with water. The final thickness of the subbase layer is 5 to 7 inches. Thereafter, a layer of phosphogypsum, preferably 4 to 7 inches, is spread over the subbase and a layer of flyash is spread over the phosphogypsum in amounts from about 20 to 50 percent by weight based upon the total weight of the phosphogypsum and flyash and the two layers are mixed and compacted to form a base layer. Water is sprayed over the surface of the base layer until the mixture is moist and soft and then compacted. The sequence of wetting and compacting is repeated until the materials are intimately mixed, densified, and the base layer is saturated with water. The final thickness of the base layer is 5 to 7 inches. Alternately, in the foregoing method, the flyash and phosphogypsum can be premixed together and then spread in one operation. If the ingredients are premixed, the subbase layer disposed over the subgrade comprises a mixture of flyash and phosphogypsum comprising 10 to 30 percent by weight flyash and 70 to 90 percent by weight phosphogypsum. The thickness of this layer is preferably 6 to 9 inches. The subbase layer is sprayed with water until the mixture is moist and soft and then compacted. These latter steps are sequentially repeated until the materials are intimately mixed, densified, and the subbase is saturated with water. The final thickness of the subbase layer is preferably 5 to 7 inches. Thereafter, a mixture of flyash and phosphogypsum comprising 10 to 30 percent by weight flyash and 70 to 90 percent by weight phosphogypsum is spread over the subbase layer to form a base layer, preferably 5 to 8 inches thick. A layer of flyash is then spread over the base layer in an amount equal to from about 10 to 20 percent by weight based upon the total weight of the base layer. The layer of flyash is mixed into the upper surface of the base layer until the flyash penetrates into the upper two-thirds of this layer and the layer is then compacted. Water is sprayed onto the base layer until the mixture is moist and soft and then compacted. The sequence of wetting and compacting is repeated until the materials are intimately mixed, densified, and the base layer is saturated with water. The final thickness of the base layer is preferably 5 to 8 inches. The load bearing surfaces produced by this method have CBR values ranging from 50 to 90 at 0.1 inch penetration.

DESCRIPTION OF THE PREFERRED EMBODIMENT

An aspect of the present invention is a method of making a load bearing surface comprising mixing flyash with phosphogypsum in predetermined amounts to form a subbase disposed on a subgrade, sequentially spraying water onto the subbase and compacting for a plurality of cycles until the materials therein are intimately mixed, densified, and the subbase layer is saturated with water. A base layer comprising a mixture of flyash and phosphogypsum in predetermined amounts is disposed on the subbase layer and sequentially sprayed with water and compacted for a plurality of cycles until the materials therein are intimately mixed, densified, and the base layer is saturated with water. The load bearing surface produced has CBR values ranging from 50 to 90 at 0.1 inch penetration.

In accordance with the present invention, a load bearing surface is formed on a subgrade or surface to be paved having high bearing characteristics. In the first step, a layer of phosphogypsum is spread over the surface of the subgrade, preferably 4 to 7 inches thick. Thereafter, a layer of flyash is spread over the surface of the phosphogypsum in an amount within the range of 10 to 30 percent by weight based upon the total weight of the phosphogypsum and flyash. The preferred flyash is one containing a high calcium content prepared from burning a Western subbituminous coal. The layer of flyash and phosphogypsum are mixed in place by pulver mixing or by discing and blading and then compacted by rolling or tamping compactors to form a subbase layer. The thickness of the mixture prior to compacting is about 6 to 9 inches. Water is sprayed on the subbase until the layer is moist and soft and then compacted. The sequence of spraying water and compacting is repeated for a plurality of cycles until the materials therein are intimately mixed, densified and the subbase layer is saturated with water. The final thickness of the subbase layer is about 5 to 7 inches. Thereafter, a layer of phosphogypsum is spread over the surface of the subbase layer, preferably 4 to 7 inches thick. A layer of flyash is then spread over the layer of phosphogypsum in an amount equal to from 20 to 50 percent by weight based upon the total weight of the phosphogypsum and flyash. The two layers are mixed in place and compacted to form a base layer. The thickness of the mixture prior to compacting is about 6 to 9 inches. Thereafter, water is sprayed over the surface of the base layer until the layer is moist and soft and then compacted. The sequence of spraying water and compacting is repeated for a plurality of cycles until the materials are intimately mixed, densified, and the base layer is saturated with water. The resulting base will have a thickness of about 5 to 7 inches. The surface of the base layer was tested and found to have CBR values ranging from 50 to 90 at 0.1 inch penetration as determined by the method described in *Asphalt Institute Manual* MS-10, ASTM D 1883 and ASTM STP 479, the disclosure of which is hereby incorporated by reference.

In still another embodiment, the phosphogypsum and flyash may be premixed together in a mixing plant or in a tank mixer and then spread in one operation. In this embodiment, a mixture of flyash and phosphogypsum comprising 10 to 30 percent by weight flyash and 70 to 90 percent by weight phosphogypsum is formed, spread over the subgrade and compacted by rolling or tamping to the form a subbase layer. The thickness of this layer is preferably 6 to 9 inches prior to compacting. Thereafter, water is sprayed over the subbase layer until the layer is moist and soft and then compacted. The sequence of wetting and compacting is repeated for a plurality of cycles until the materials are intimately mixed, densified, and the subbase is saturated with water. The final thickness of the subbase is 5 to 7 inches. Thereafter, a mixture of flyash and phosphogypsum comprising 10 to 30 percent by weight flyash and 70 to 90 percent by weight phosphogypsum is spread over the subbase layer to form a base layer. The thickness of this layer is preferably 5 to 8 inches. A layer of flyash is spread over the base layer in an amount equal to from about 10 to 20 percent by weight based upon the total weight of the base layer and the layer of flyash is mixed into the upper surface of the base layer until the flyash penetrates into the upper two-thirds of the thickness of the base layer. The base layer containing additional flyash in the upper portion thereof is then compacted. Water is then sprayed onto the surface of the base layer until the layer is moist and soft and compacted. The sequence of wetting and compacting the base layer is repeated for a plurality of cycles until the materials are intimately mixed, densified, and the base layer is saturated with water. The surface of the base layer was tested and found to have CBR values ranging from 50 to 90 at 0.1 inch penetration.

In still another embodiment of the present invention, a layer of phosphogypsum having a predetermined thickness, preferably 4 to 7 inches, is spread over the subgrade or surface to be paved, and a layer of flyash is spread over the phosphogypsum. The amount of flyash spread over the phosphogypsum is within the range of 10 to 50 percent by weight based upon the weight of the flyash and the phosphogypsum. The layers of flyash and phosphogypsum are then mixed in place by pulver mixing or by discing and blading and then compacted by rolling or tamping to form a subbase layer. Alternately, the flyash and phosphogypsum can be premixed together in a mixing plant or in a tank mixer and then spread over the subgrade surface in one operation and compacted. Water is then sprayed on the subbase layer until the layer is moist and soft, and then compacted. The sequence of wetting and compacting is repeated for a plurality of cycles until the materials are intimately mixed, densified, and the subbase layer is saturated with water. Thereafter, a mixture of flyash and phosphogypsum containing 10 to 50 percent by weight flyash based upon the total weight of the admixture is spread over the subbase layer and compacted to form a base layer. The base layer is sprayed with water until it is moist and soft and then compacted, and this sequence is repeated for a plurality of cycles until the materials are intimately mixed, densified, and the base layer is saturated with water. The final thickness of the base layer is preferably 6 to 9 inches. Thereafter, a layer of flyash is spread over the base layer in an amount of 20 to 30 percent by weight based upon the weight of the base layer and compacted into the upper surface of the base layer. The surface of the base layer was tested and found to have CBR values ranging from 50 to 80 at 0.1 inch penetration.

The following examples illustrate in a nonlimiting way and in practical cases results of field tests utilizing mixtures of flyash and phosphogypsum and other ingredients in preparing various load bearing surfaces.

EXAMPLE 1

A layer of reclaimed flyash, 2 inches thick, was spread over a subgrade 143 feet by 69 feet, watered to moist conditions and cut into 6 inches of the soil. Leveled, disced, compacted, and plowed over and repeated three times producing a compacted subbase. Added phosphogypsum spread to a depth of 4 inches. Added 2 inches of flyash on top of the phosphogypsum, mixed the flyash and phosphogypsum by discing, blading, compacting and plowing over a minimum of four cycles to ensure mixing and breaking of any lumps or cracks. Sprayed water and compacted and repeated this sequence using a sheeps foot tamping roller until water runs off and no air bubbles come up from the compacted base. The resulting base was finished with a rubber blade roller and bladed to contour. Added a layer of granular reclaimed flyash and rolled into the surface with a steelwheel roller to provide a wear surface. The wear surface was then oiled very lightly with MC-30 or cut oil. Field tests showed CBR values ranging from 79 to 132 at 0.1 inch penetration.

EXAMPLE 2

A field test pavement about 20,000 square feet in area was prepared according to the following steps:

1. Excavated old surface, graded subgrade and installed underground drainage system.
2. Added 3 inches phosphogypsum.
3. Pulver mixed 7 inches deep.
4. Laid one inch of dry flyash and pulver mixed 7 to 8 inches;
5. Bladed and rolled with tamping compactor.
6. Remixed, added water and compacted.
7. Added 28 tons of cement to center one-third area, 7 tons of hydrated lime to east one-third area, and 25 tons of reclaimed flyash to west one-third area.
8. Pulver mixed 7 to 8 inches deep.
9. Bladed, compacted and added water for two days and allowed to set for two days.
10. Added 5 inches phosphogypsum and 2 inches of reclaimed flyash.
11. Pulver mixed 7 inches deep.
12. Bladed, compacted and watered.
13. Tamped for two days, recompacted and rubber tire rolled for 1.5 days.
14. Installed asphalt.
15. Applied sealer gilsonite.

Field CBR tests prior to asphalt surfacing were performed and the values at 0.1 inch penetration ranged from 56 to 79 for the flyash/phosphogypsum surface, 88 to 99 for the flyash/phosphogypsum/cement surface, and 65 to 67 for the flyash/phosphogypsum/lime surface.

EXAMPLE 3

A pavement 75 feet by 210 feet was prepared according to the following steps:

1. Added 4 inches phosphogypsum and dry flyash on top of fabric.
2. Pulver mixed 4 inches deep.
3. Rolled, compacted, watered, compacted.
4. Sealed, rolled (rubber tire roller) tight bladed.
5. Added 2 inches crushed slag, rolled.
6. Oiled lightly.

Field CBR tests ranged from 57 to 95 at 0.1 inch penetration on the flyash/phosphogypsum base.

The postulated mechanism for the strength of the mixture of the present invention is that the phosphogypsum reacts with portions of the flyash to form a calcium aluminum silicate which will harden in the presence of moisture.

The flyash used in the present invention is that produced by the combustion of Western subbutiminous coal and may be fresh dry flyash or moist flyash reclaimed from storage ponds.

Still other modifications of the present invention will be apparent to those skilled in the art. The claims appended hereto are intended to cover all such embodiments and equivalent thereof within the true scope of the present invention.

What is claimed is:

1. A method of producing a load bearing surface disposed on a subgrade, comprising the steps of:

(a) spreading a layer of phosphogypsum having a predetermined thickness over the surface of the subgrade;

(b) spreading a layer of flyash over the surface of said layer of phosphogypsum in an amount from about 10 to 30 percent by weight based upon the total weight of the phosphogypsum and flyash;

(c) mixing said flyash and phosphogypsum and compacting said mixture to form a subbase layer;

(d) spraying water over the surface of said subbase layer until the layer is moist and soft and then compacting said layer;

(e) repeating step (d) for a plurality of cycles until the materials are intimately mixed, densified, and the layer is saturated with water;

(f) spreading a layer of phosphogypsum having a predetermined thickness over the surface of said subbase layer;

(g) spreading a layer of flyash over the surface of said layer of phosphogypsum overlying the subbase layer in an amount from about 20 to 50 percent by weight based upon the total weight of the phosphogypsum and flyash;

(h) mixing said flyash and phosphogypsum and compacting said mixture to form a base layer;

(i) spraying water over the surface of said base layer until the layer is moist and soft and then compacting said layer; and (j) repeating step (i) for a plurality of cycles until the materials are intimately mixed, densified, and the layer is saturated with water.

2. The method of claim 1 wherein said flyash is produced from a Western subbituminous coal having a high calcium content.

3. The method of claim 1 wherein the thickness of the phosphogypsum layer described in steps (a) and (f) is 4 to 7 inches.

4. The method of claim 1 wherein the mixed layer of phosphogypsum and flyash according to steps (c) and (j) is 6 to 9 inches prior to compacting.

5. The method of claim 1 wherein the final thickness of the subbase and base layer is 5 to 7 inches.

6. The method of claim 1 wherein the surface of the base layer according to step (j) has CBR values ranging from 50 to 90.

7. The method of claim 1 wherein said layer of phosphogypsum and flyash are mixed by pulver mixing or discing and blading.

8. A load bearing surface overlying a subgrade surface produced in accordance with the method of claim 1.

9. A method of producing a load bearing surface disposed on a subgrade, comprising the steps of:

(a) forming a mixture of flyash and phosphogypsum comprising 10 to 30 percent by weight flyash and 70 to 90 percent by weight phosphogypsum;

(b) spreading a layer of said mixture over said subgrade having a predetermined thickness and compacting said layer to form a subbase layer;

(c) spraying water over the surface of said subbase layer until the layer is moist and soft and then compacting said layer;

(d) repeating step (c) for a plurality of cycles until the materials are intimately mixed, densified, and the layer is saturated with water;

(e) repeating step (a) and spreading a layer of said mixture having a predetermined thickness over said subbase to form a base layer;

(f) spreading flyash over the surface of said base layer in an amount equal to from about 10 to 30 percent by weight based upon the total weight of the base layer, mixing said layer of flyash into the upper surface of said base layer until said flyash penetrates into the upper two-thirds of said base layer, and then compacting said layer;

(g) spraying water over the surface of said base layer containing additional flyash in the upper portion thereof until the layer is moist and soft, and then compacting said layer; and (h) repeating step (g) for a plurality of cycles until the materials are intimately mixed, densified, and the layer is saturated with water.

10. The method of claim 9 wherein the thickness of said layer described in step (b) is 6 to 9 inches.

11. The method of claim 9 wherein the thickness of said layer described in step (e) is 5 to 8 inches.

12. The method of claim 9 wherein the final thickness of said subbase and said base layer is 5 to 7 inches.

13. The method of claim 9 wherein the thickness of the subbase layer according to step (d) is 5 to 7 inches.

14. The method of claim 9 wherein the thickness of the base layer according to step (h) is 5 to 8 inches.

15. The method of claim 9 wherein said flyash is produced from a Western subbituminous coal having a high calcium content.

16. The method of claim 9 wherein the surface of the base layer according to step (h) has CBR values ranging from 50 to 90.

17. A load bearing surface overlying a subgrade surface produced in accordance with the method of claim 9.

* * * * *

UNITED STATES PATENT AND TRADEMARK OFFICE

CERTIFICATE OF CORRECTION

PATENT NO. : 4,448,566

DATED : May 15, 1984

INVENTOR(S) : H. Hobson KING

It is certified that error appears in the above-identified patent and that said Letters Patent are hereby corrected as shown below:

Col. 1, line 36, change "$CaSO_4.2H_2O$." to --$CaSO_4 \cdot 2H_2O$.--

Col. 1, line 42, change "May et al." to --May et al--

Col. 4, line 15, "soft and compacted" should read --soft and then compacted--

Col. 5, line 52, "top of fabric." should read --top of a geotechnical fabric.--

Signed and Sealed this

*Twenty-ninth* Day of *January 1985*

[SEAL]

*Attest:*

DONALD J. QUIGG

*Attesting Officer* *Acting Commissioner of Patents and Trademarks*